US011286672B2

(12) United States Patent
Ellis

(10) Patent No.: US 11,286,672 B2
(45) Date of Patent: Mar. 29, 2022

(54) METHOD OF JOINING DOWNSPOUT COMPONENTS WITHOUT FASTENERS

(71) Applicant: John Paul Ellis, Muskego, WI (US)

(72) Inventor: John Paul Ellis, Muskego, WI (US)

( * ) Notice: Subject to any disclaimer, the term of this patent is extended or adjusted under 35 U.S.C. 154(b) by 0 days.

(21) Appl. No.: 16/948,389

(22) Filed: Sep. 16, 2020

(65) Prior Publication Data

US 2021/0301537 A1 Sep. 30, 2021

Related U.S. Application Data

(60) Provisional application No. 63/001,630, filed on Mar. 30, 2020.

(51) Int. Cl.
*E04D 13/08* (2006.01)

(52) U.S. Cl.
CPC ..... *E04D 13/08* (2013.01); *E04D 2013/0846* (2013.01)

(58) Field of Classification Search
CPC ..... E04D 13/08; E04D 2013/0846; E04D 13/0645; E04D 13/068; E04D 13/076; E04D 2013/0806; E04D 2013/0813; E04D 2013/0833
See application file for complete search history.

(56) References Cited

U.S. PATENT DOCUMENTS 1,126,854 A * 2/1915 Peterson et al. ..... E04D 13/064 52/15
2,523,881 A * 9/1950 Shea ..... E04D 13/08 210/316
2,676,038 A * 4/1954 McConnell ..... F16L 21/005 285/81
2,726,682 A * 12/1955 Conroy ..... F16L 33/00 285/236
3,076,669 A * 2/1963 Schlein ..... F16L 43/008 285/179
3,718,351 A * 2/1973 Bakkerus ..... F16L 21/005 285/236
3,887,221 A * 6/1975 Young ..... F16L 25/14 285/236
3,966,121 A * 6/1976 Littman ..... A01G 25/02 239/197
4,187,590 A * 2/1980 Harris ..... F16B 5/0692 24/102 A
4,270,572 A * 6/1981 Jarzynka ..... E04D 13/08 137/615
5,358,007 A * 10/1994 Carlberg ..... E03F 1/002 137/561 A
5,406,966 A * 4/1995 Lepkowski ..... B08B 3/02 134/104.4

(Continued)

FOREIGN PATENT DOCUMENTS

JP 2004251067 A * 9/2004
JP 2004293144 A * 10/2004

*Primary Examiner* — James M Ference
(74) *Attorney, Agent, or Firm* — Dunlap Bennett & Ludwig, PLLC

(57) ABSTRACT

A method of fluidly connecting two downspout components without fasteners. The method embodies an elastic band dimensioned to slidably receive connecting ends of the two downspout components in such a way that the material of the elastic band frictionally engages the received connecting ends in a seamless, fastener-less, drip-free seal.

6 Claims, 4 Drawing Sheets

(56) References Cited

U.S. PATENT DOCUMENTS 5,607,124 A * 3/1997 Earley ..... E04D 13/08 248/48.1
5,867,944 A * 2/1999 Attaway ..... E04D 13/08 52/16
6,145,895 A * 11/2000 Patel ..... F16L 21/005 285/222.3
6,223,777 B1 * 5/2001 Smith ..... E04D 13/0645 138/109
6,647,670 B1 * 11/2003 Dran ..... E04D 13/08 52/16
8,631,830 B2 * 1/2014 Gosis ..... F16L 47/265 138/109
8,689,837 B1 * 4/2014 Smith ..... F16L 25/0063 138/118
8,938,858 B2 * 1/2015 Bailey ..... E05D 5/127 16/390
9,091,071 B2 * 7/2015 Crawford ..... E04D 13/08
9,238,916 B2 * 1/2016 Schneider ..... E04D 13/08
9,534,391 B2 * 1/2017 Haley ..... E04D 13/068
9,598,868 B2 * 3/2017 Lolio, Jr. ..... E04D 13/0645
9,783,989 B2 * 10/2017 Elder ..... E04D 13/08
10,519,670 B2 * 12/2019 Hennings ..... E04D 13/068
2005/0160681 A1 * 7/2005 Boelling ..... E04D 13/08 52/16
2006/0016129 A1 * 1/2006 Riese ..... E04D 13/08 52/16
2010/0126078 A1 * 5/2010 Leahy ..... E04D 13/08 52/16
2011/0088791 A1 * 4/2011 Primm, Jr. ..... E04D 13/08 137/356
2011/0173897 A1 * 7/2011 Schneider ..... E04D 13/08 52/16
2012/0285567 A1 * 11/2012 Kessler ..... E04D 13/08 137/615
2013/0161943 A1 * 6/2013 Bailey ..... E05D 5/127 285/283
2013/0161944 A1 * 6/2013 Bailey ..... E05D 5/06 285/283
2016/0025263 A1 * 1/2016 Gibbons ..... F16B 2/08 248/216.1
2016/0281364 A1 * 9/2016 Lolio, Jr. ..... E04D 13/0645
2017/0152662 A1 * 6/2017 Elder ..... E04D 13/08
2017/0234030 A1 * 8/2017 Macias ..... E04H 15/34 135/20.1
2017/0274430 A1 * 9/2017 Brick ..... B08B 9/0328
2018/0340335 A1 * 11/2018 Hennings ..... E04D 13/08
2019/0194953 A1 * 6/2019 McNinch ..... E04F 17/026
2019/0330852 A1 * 10/2019 Gori ..... E04D 13/068

* cited by examiner

METHOD OF JOINING DOWNSPOUT COMPONENTS WITHOUT FASTENERS

CROSS-REFERENCE TO RELATED APPLICATION

This application claims the benefit of priority of U.S. provisional application No. 63/001,630, filed 30 Mar. 2020, the contents of which are herein incorporated by reference.

BACKGROUND OF THE INVENTION

The present invention relates to conduit fasteners and, more particularly, an elastic band that holds two downspout components together without fasteners, and a method of installing the same without tools.

Currently downspouts are held in place by screws or similar fasteners like rivets. These fasteners require tools to install and loosen over time causing the once-joined downspout components to come apart, which in turn can result in a misfunctioning downspout that does not properly diverting rainwater.

As mentioned above, conventional methods of holding downspouts together is through screws or rivets, which are rigid and utilize a small surface holding area, making them difficult to install. Their small surface area also makes these fasteners prone to becoming loose, causing the downspouts to come apart. Furthermore, the holes needed for these fasteners to work are prone to rusting, which can spread along the exterior of the downspout, causing unsightly discoloring. Likewise, other fasteners, such as fittings, require a specific seam element, such as threading, which promote rusting at the discontinuity between the outer surface of the conduit and the specific seam element.

As can be seen, there is a need for an elastic band that holds two downspout components together without fasteners, and a method of installing the same without tools.

The present invention embodies an elastic band dimensioned and adapted to simply slip over the inserted downspout parts, whereby no tools or fasteners are required for installation or maintaining the resulting seal between the inserted downspout parts. The elastic bands are flexible and have a much larger surface holding area for joining the parts of a downspout through, in part, elastic compression and frictional engagement. The elastic bands can come in any color to match different downspouts, providing a seamless drip-free seal that lasts and is not prone to rust.

SUMMARY OF THE INVENTION

In one aspect of the present invention, a method of seamlessly joining two downspout components without a tool so that a drip-free fluid connection is maintained between the two downspout components without fasteners, the method includes the following: sliding a first connecting end of a first of the two downspout components into a first end of an elastic band; and sliding a second connecting end of a second of the two downspout components into a second end of the elastic band.

In another aspect of the present invention, method of seamlessly joining two downspout components without a tool so that a drip-free fluid connection is maintained between the two downspout components without fasteners, the method includes the following: sliding a first connecting end of a first of the two downspout components into a first end of a silicone elastic band; and sliding a second connecting end of a second of the two downspout components into a second end of the silicone elastic band, wherein the first connecting end and the second connecting end abut or are adjacent in a lumen of the silicone elastic band, and wherein the silicone elastic band is dimensioned to frictionally engage an outer surface of each connecting end.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a method of fluidly connecting two downspout components without fasteners. The method embodies an elastic band dimensioned to slidably receive connecting ends of the two downspout components in such a way that the material of the elastic band frictionally engages the received connecting ends in a seamless, fastener-less, drip-free seal, where no additional tools are required during installation. In other words, the elastic band simply slips over inserted downspout parts to hold them together through friction.

Figure 1:
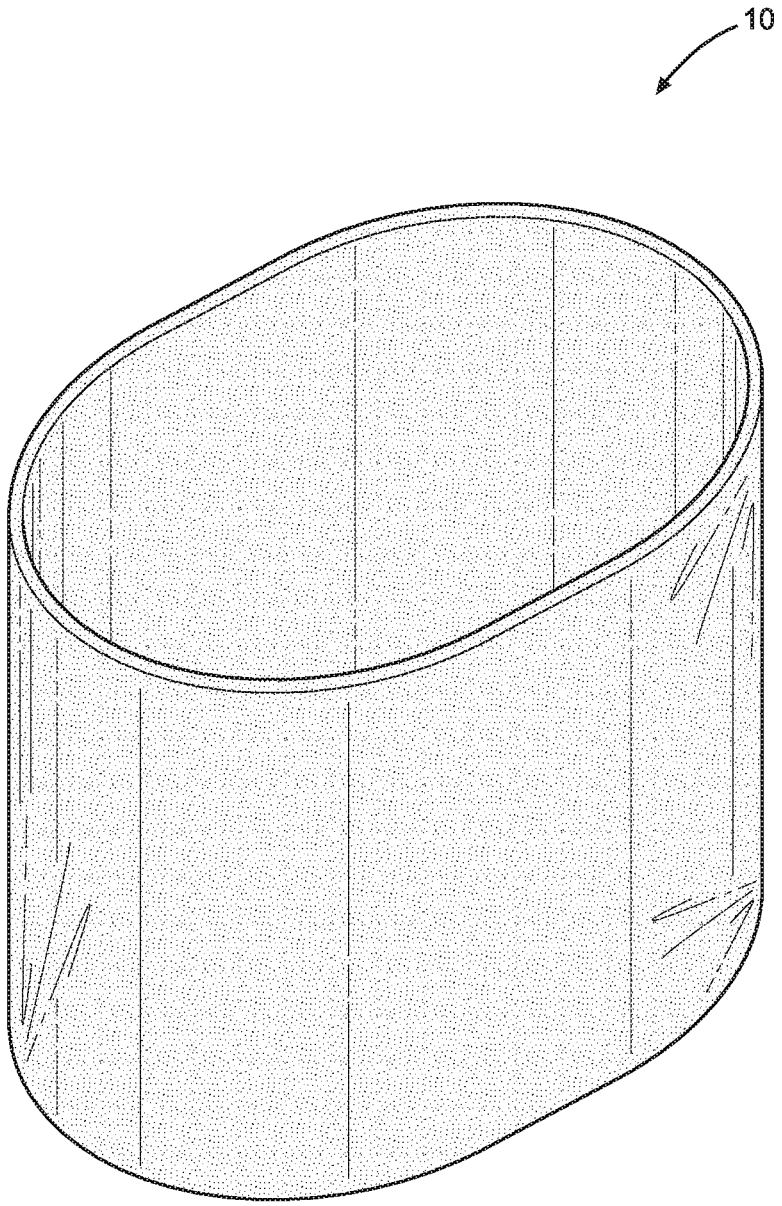
FIG. 1 is a perspective view of an exemplary embodiment of the present invention.
Figure 2:
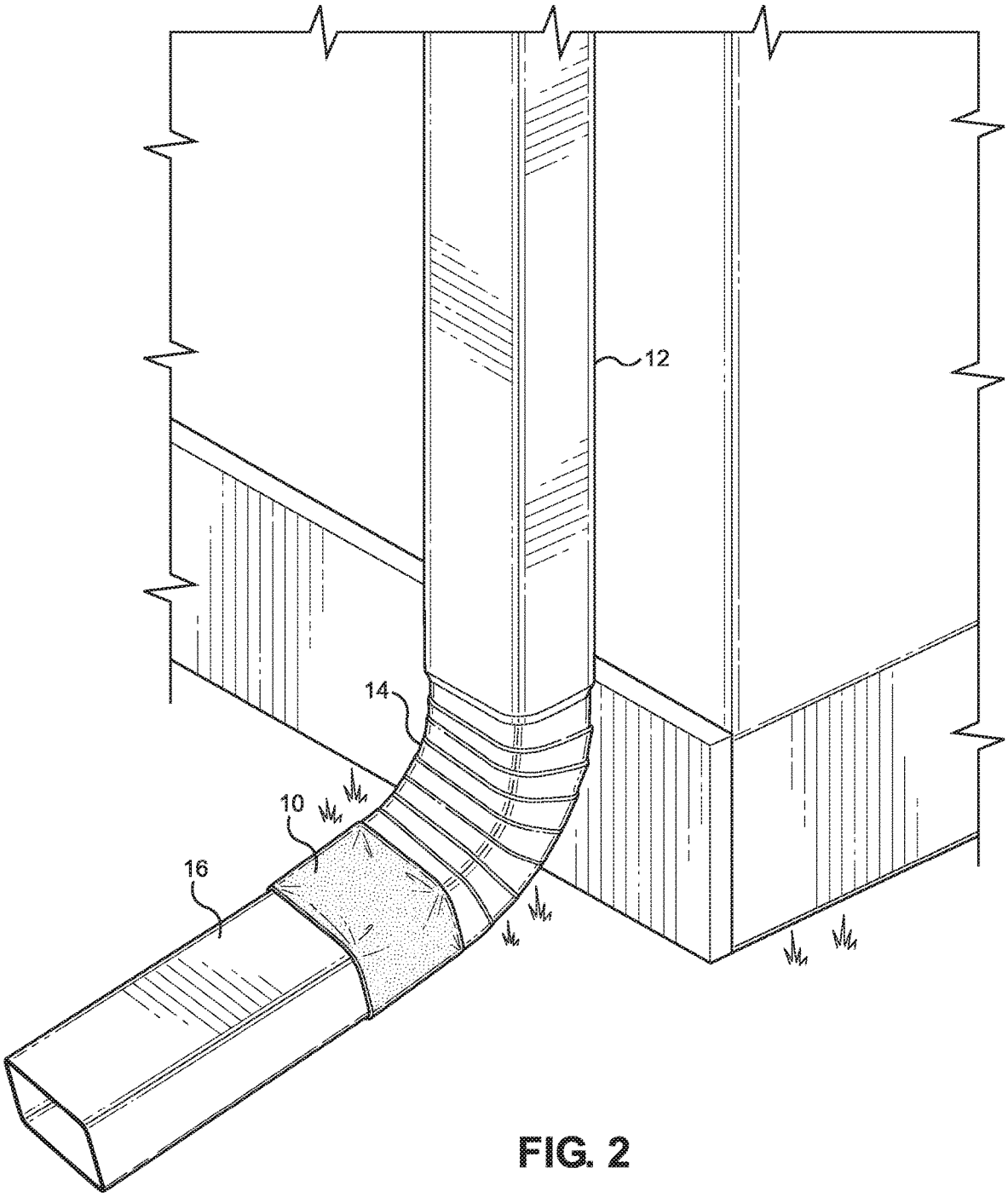
FIG. 2 is a perspective view of an exemplary embodiment of the present invention shown in use.
Figure 3:
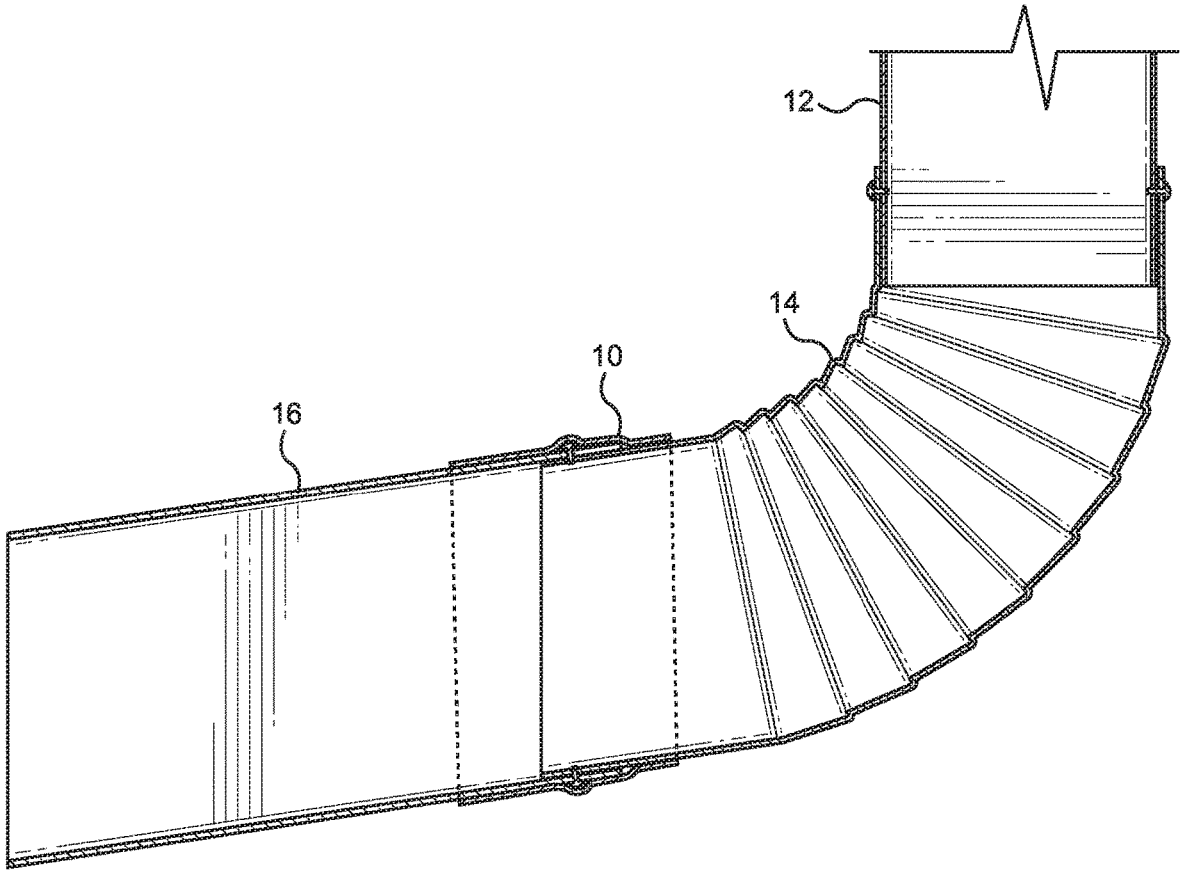
FIG. 3 is a cross-section view of an exemplary embodiment of the present invention, shown in use.
Figure 4:
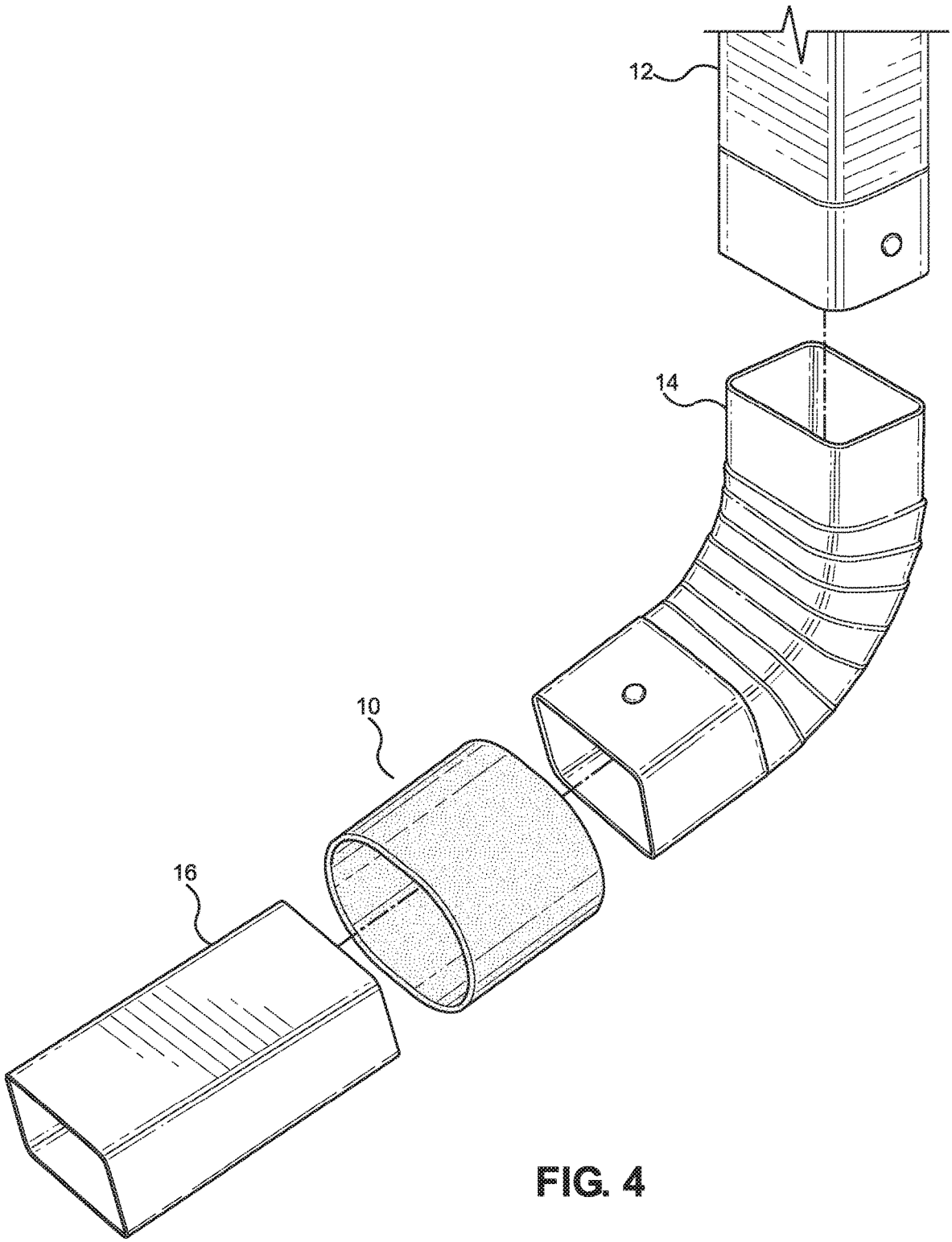
FIG. 4 is an exploded perspective view of an exemplary embodiment of the present invention.

Referring now to FIGS. 1 through 4, the present invention may include an elastic band 10 used to hold conduits 12, such as downspouts, together. The elastic band 10 may be of unitary construction, having a first opening on one end and a second opening on the opposing end. The elastic band 10 is dimensioned and adapted to slidably receive a first conduit component 14, while the second opening slidably receives a second conduit component 16. The elastic band 10 may have a flat length between five and eight inches, and in some embodiments approximately six and a quarter inch. The elastic band 10 may have a width of two to four inches, and in some embodiments, three inches. The elastic band 10 may have a wall thickness of between 0.04 and 0.08 inches, and in some embodiments 0.063 inches. In one embodiment, the first conduit component 14 may be a downspout elbow joint while the second conduit component 16 may be a downspout extender.

In some but not all embodiments the received ends of the respective conduit components 14 and 16 may abut each other or be adjacent each other inside the lumen of the elastic band 10. The material of the elastic band 10 along with the dimensionality of its openings work in concert to elastically compress the received, distal ends of the first and second conduit components 14 and 16, forming a seamless drip-free seal without other fasteners. The material of the elastic band 10 may frictionally engage the outer surfaces of the conduit components 14 and 16 to firmly hold them in place. The material of the elastic band 10 may be silicone of the like.

It should be understood, of course, that the foregoing relates to exemplary embodiments of the invention and that modifications may be made without departing from the spirit and scope of the invention as set forth in the following claims.

What is claimed is:

1. A method of seamlessly joining two downspout components without a tool so that a drip-free fluid connection is maintained between the two downspout components without fasteners, the method comprising:

sliding a first connecting end of a first of the two downspout components into a first end of an elastic band; and sliding a second connecting end of a second of the two downspout components into a second end of the elastic band, wherein the first connecting end and the second connecting end overlap each other in a lumen of the elastic band.

2. The method of claim 1, wherein the elastic band is made of silicone.

3. The method of claim 1, wherein the elastic band is dimensioned to frictionally engage an outer surface of each of the first and second connecting ends.

4. The method of claim 1, wherein the elastic band has a length of 6.3 inches, a width of 3.0 inches, and a thickness of 0.06 inches.

5. A method of seamlessly joining two downspout components without a tool so that a drip-free fluid connection is maintained between the two downspout components without fasteners, the method comprising:

sliding a first connecting end of a first of the two downspout components into a first end of a silicone elastic band; and sliding a second connecting end of a second of the two downspout components into a second end of the silicone elastic band, wherein the first connecting end and the second connecting end overlap each other in a lumen of the silicone elastic band, and wherein the silicone elastic band is dimensioned to frictionally engage an outer surface of each of the first and second connecting ends.

6. The method of claim 5, wherein the elastic band has a length of 6.3 inches, a width of 3.0 inches, and a thickness of 0.06 inches.

* * * * *